US005439534A

United States Patent [19]

Takeuchi et al.

[11] Patent Number: 5,439,534

[45] Date of Patent: Aug. 8, 1995

[54] METHOD OF MANUFACTURING AND APPLYING HEAT TREATMENT TO A MAGNETIC CORE

[75] Inventors: Masato Takeuchi; Yoshihiko Hirota; Hiroshi Ohmori; Masaru Yoshimura, all of Sodegaura, Japan

[73] Assignee: Mitsui Petrochemical Industries, Ltd., Tokyo, Japan

[21] Appl. No.: 941,113

[22] PCT Filed: Mar. 4, 1992

[86] PCT No.: PCT/JP92/00256

§ 371 Date: Nov. 4, 1992

§ 102(e) Date: Nov. 4, 1992

[87] PCT Pub. No.: WO92/15997

PCT Pub. Date: Sep. 17, 1992

[30] Foreign Application Priority Data

Mar. 4, 1991 [JP] Japan ..... 3-037642
Mar. 4, 1991 [JP] Japan ..... 3-037643
Mar. 4, 1991 [JP] Japan ..... 3-037644
Mar. 4, 1991 [JP] Japan ..... 3-037645

[51] Int. Cl.[6] ..... C21D 1/76
[52] U.S. Cl. ..... 148/105; 148/122
[58] Field of Search ..... 148/108, 122, 105; 24/605, 609

[56] References Cited

U.S. PATENT DOCUMENTS 4,314,594 2/1982 Pfeifer et al. ..... 148/108
4,812,181 3/1989 Hilzinger ..... 148/121
5,143,542 9/1992 Miyazawa et al. ..... 148/105

FOREIGN PATENT DOCUMENTS 3215263 11/1982 Germany .
59-4109 1/1984 Japan .
63-24016 2/1988 Japan .
64-36726 2/1989 Japan .
2-194503 8/1990 Japan .
WO9215997 9/1992 Japan .

OTHER PUBLICATIONS

Journal of Japan Institution of Metals, vol. 52, No. 4, (1988), pp. 420–427.
Technical Report (Kawasaki Steel Corporation), vol. 21, No. 4, (1989) pp. 316–322.
Iron Base Amorphous Alloys for High Frequency Applications (Datta) Proceeding of 4th International Conf. on Rapidly Quenched Metals (Sendai, 1981) pp. 1007–1010.

*Primary Examiner*—George Wyszomierski
*Attorney, Agent, or Firm*—Sherman & Shalloway

[57] ABSTRACT

A magnetic core having a low core loss and having stable characteristics in a low magnetic permeability region can be obtained at a high yield by applying a heat treatment to a magnetic core main body obtained by winding or laminating a ferrous amorphous ribbon In a wet atmosphere containing a limited amount of steam. Further, a magnetic core having stable characteristics for the quality of products can always be obtained at a high yield even when magnetic ribbons as the blank have scattering, by adopting a method of applying a heat treatment to the magnetic core main body as described above by measuring the curie point, the differentiated crystallization temperature or the crystallization temperature of optionally sampled amorphous ribbons and comparing the measured value for the temperature with the curie point corresponding to the heat treatment temperature for the previously prepared aimed magnetic permeability, the differentiated crystallization temperature or the crystallization peak temperature, thereby determining an optimum value for the heat treatment temperature.

13 Claims, 17 Drawing Sheets

METHOD OF MANUFACTURING AND APPLYING HEAT TREATMENT TO A MAGNETIC CORE

TECHNICAL FIELD OF THE INVENTION

The present invention relates to a method of manufacturing a magnetic core of excellent constancy of magnetic permeability used as a core of noise filters for smoothing ripple components superimposed on DC current or for normal mode use, as well as for active filters or high frequency transformers, and it also relates to a technique effectively applied to the manufacturing method.

BACKGROUND OF THE INVENTION

Noise filters or choke coils used for high frequency transformers of this kind are required to have a substantially constancy of magnetic permeability, that is, a magnetic permeability not greatly depending on the intensity of magnetic field H but remains substantially constant. For satisfying the constancy of magnetic permeability, in a so-called amorphous core made of an amorphous alloy, thin film of a ferrous amorphous alloy (hereinafter referred to as an amorphous ribbon or a magnetic ribbon) Is wound by a required number of turns, applied with a heat treatment and impregnated with an adhesive such as an epoxy resin and, after hardening, a gap for disconnecting a part of a magnetic flux path is disposed to attain the constancy of magnetic permeability.

Since it is expected that the choke coils of this kind will be used in near future in a high frequency region of several hundreds kHz or higher, it is necessary in such high frequency region to minimize the heat generated from the core, that is, the core loss (iron loss) as low as possible.

In view of the above, the magnetic core formed with the gap as described above involves a problem that the core loss is increased remarkably due to insulation failure or the like at the cutting surface, in addition to compressive stresses upon impregnation and hardening of tile epoxy resin and working strain upon cutting.

In view of tile foregoings, various techniques have been proposed for attaining the constancy of magnetic permeability without forming the gap.

In the earliest study made by A. Datta, et al, it was described in "Proc. 4th Int. Conf. on Rapidly Metals" (pp 1007–1010) published in 1981, that $\alpha$-Fe fine crystallites are deposited near the surface of an amorphous ribbon after the heat treatment, which provide the constancy of magnetic permeability.

Then, it was proposed in Japanese Patent Laid-Open No. Sho. 63-24016 to apply a heat treatment at a low temperature lower than the temperature for the crystallization for more than 10 hours and stably suppress the crystallization at the surface, to attain the constancy of magnetic permeability.

However, in the above-mentioned prior art, since a core having an aimed constancy of magnetic permeability is obtained by precipitating fine crystallites at the surface of the amorphous ribbon, even a slight temperature change in the heat treatment results in the fluctuation of the magnetic permeability and involves a problem that products of stable quality can not be supplied by a great amount.

On the other hand, for the crystallization at the surface of the ferrous amorphous ribbon, N. Motira et al have reported in J. Japan, Inst. Metals, Vol. 52, No. 4 (1988), pp 420–427, that they found phenomena for the occurrence of crystallization near the surface layer of the amorphous ribbon (Fe-B-Si series) and, at the same time, deteriorating of core loss if water is contained in the heat treatment atmosphere. According to the report, when a thin film amorphous alloy $Fe_{78.5}B_{13}S_{8.5}$ is annealed at 673K, the core loss is improved by the annealing among At, $N_2$, dry $H_2$ and $N_2+O_2$ and there is substantially no difference between the values of the core loss. However, it is described that the core loss is deteriorated by annealing the amorphous ribbon in a wet $H_2$ atmosphere with a dew point of 323 K (50° C.). However, the literature mentions nothing about a heat treatment method for attaining a constancy of magnetic permeability.

DISCLOSURE OF THE INVENTION

A first object of the present invention is to provide a core (magnetic core) having a constancy of magnetic permeability also in a case of not forming a gap, by controlling heat treatment conditions, particularly, the amount of steam in the heat treatment atmosphere and provide a core (magnetic core) capable of extending the range for the heat treatment temperature, with less core loss and having stable characteristic in a low magnetic permeability region.

A method of manufacturing a magnetic core according to the present invention for attaining the first object comprises applying a heat treatment to a magnetic core main body comprised of a ferrous amorphous alloy in a wet atmosphere containing unit amount of steam from 5 to 500g/m$^3$ converted into that at 25° C.

The present inventors have accomplished the manufacturing method of the present invention in a case where the predetermined amount of steam is introduced into the atmosphere for the heat treatment, by which a stable constancy of magnetic permeability can be obtained also in a case not forming a gap and in a low magnetic permeability region over a wide temperature range with less core loss.

In this method, a magnetic core main body is used. The magnetic core main body used herein is prepared by winding or laminating a ferrous amorphous alloy ribbon (thin film). For example, the magnetic core main body is obtained either by processing a ribbon made of an amorphous metal ribbon (thin film) in the form of a slit, winding it and attaching a Kapton tape etc. and to the winded end to fix or by laminating the amorphous alloy ribbon and if necessary, punching thereafter.

The amorphous alloy used in the present invention is a Fe-based amorphous alloy with tile Fe content of greater than 50 atom % in the alloy. As tile Fe-based amorphous alloy, there can be mentioned, for example, Fe series alloys such as Fe-B, Fe-B-C, Fe-B-Si, Fe-B-Si-C, Fe-B-Si-Cr, Fe-Co-B-Si and Fe-Ni-Mo-B.

Among them, most preferable Fe-based amorphous metal is, for example, $Fe_XSi_YB_ZM_W$. Each of X, Y and Z represents atom % and ranges as: X=50–85, Y=-5–15, Z =5–25. Further, M is an alloy comprising one or more of Co, Ni, Nb, Ta, Mo, W, Zr, Cu, Cr, Mn, Al and P. W represents atom % and ranges 0–10, preferably 0 to 5.

In the manufacturing method for the magnetic core according to the present invention, the magnetic core main body is applied with a heat treatment in a wet atmosphere. The wet atmosphere contains unit amount of steam from 5 to 500 g/m$^3$ converted as that at 25° C. By setting the amount of steam in the wet atmosphere within the range of 5 to 500 g/m$^3$, a stable constancy of magnetic permeability can be obtained for a wide temperature range, with loss core less, in a low magnetic permeability region even in a case of not disposing the gap.

In the invention, the term "unit amount of steam converted as that at 25° C." means unit amount of steam when unit amount of steam in a gas atmosphere at a predetermined temperature (heat treatment temperature) was converted under the atmospheric air pressure at 25° C.

In the present invention, the unit amount of steam is preferable in the range of 8–200 g/m$^3$, more preferably in the range of 10–80 g/m$^3$, and most preferably in the range of 20–80 g/m$^3$.

The atmosphere for the heat treatment may have the same conditions as those of the atmospheric air and peeling of the kapton tape used for fixing the end of the amorphous ribbon can be prevented by using an inert gas atmosphere such as nitrogen, argon or helium atmosphere. An inert gas atmosphere is preferred because a good weather-resistant film can be formed on the surface of the magnetic core. For practical uses, the nitrogen atmosphere is more preferable.

DETAILED DESCRIPTION OF THE DRAWINGS

Figure 5:
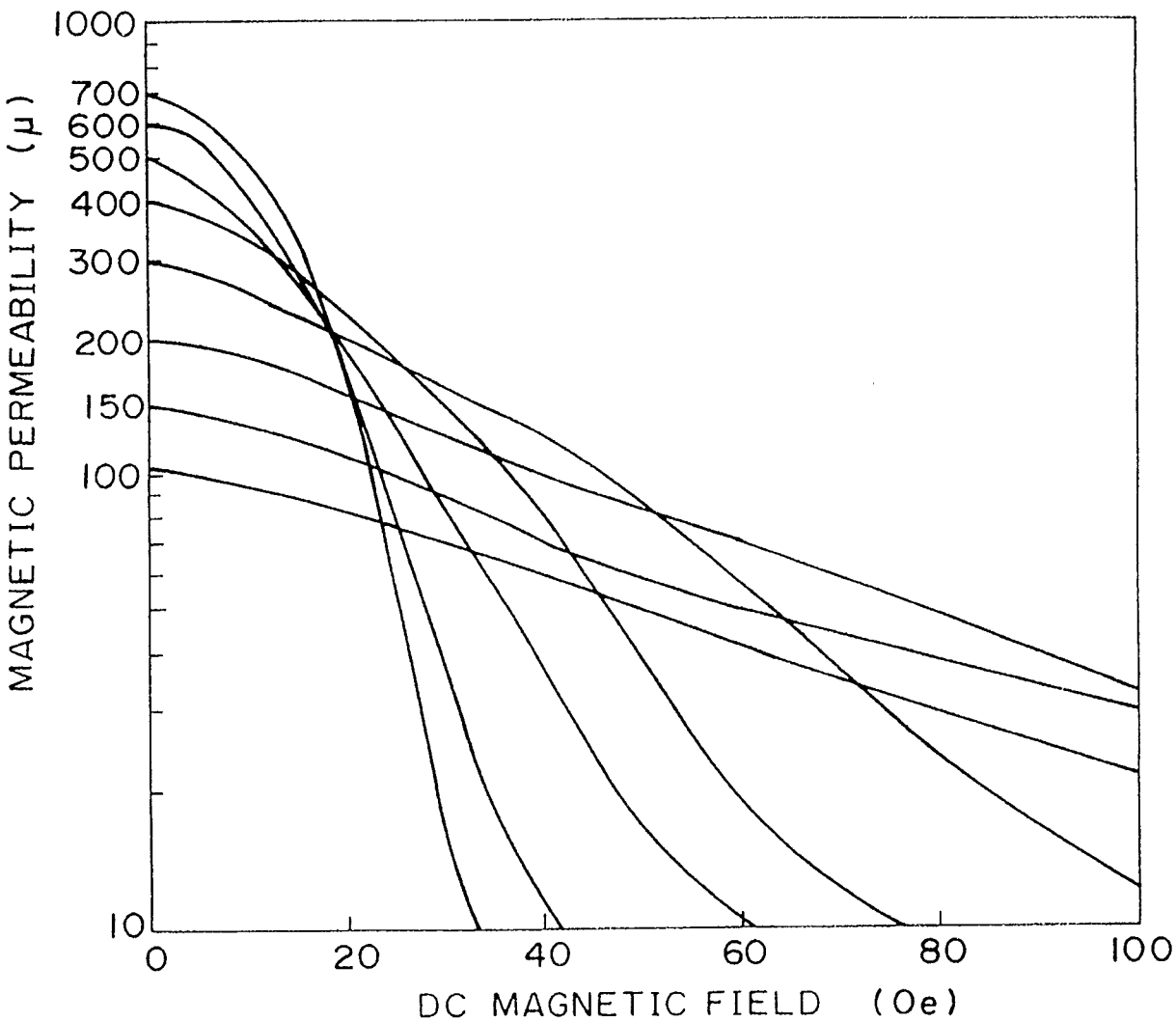
FIG. 5 is a graph illustrating the change of the magnetic permeability to the DC-superimposed magnetic field.

FIG. 5 shows a graph illustrating the change of the magnetic permeability along with the increase of the DC-superimposed magnetic field for each of the heat treatment temperatures. Referring to the aimed constancy of magnetic permeability, it is desirable that the magnetic permeability is not decreased so abruptly by the increase of the DC superimposed magnetic field as represented, for example by a dust type smoothing choke.

As can be seen from the figure, the permeability under superposition of the DC magnetic field, that is, the constancy of magnetic permeability can be estimated by merely measuring the magnetic permeability in a state where no magnetic field is applied (00e).

Accordingly, the constancy of magnetic permeability can naturally be attained by reducing the magnetic permeability of the magnetic core in a state where no magnetic field is applied (00e).

By the way, tile magnetic permeability can be reduced generally by elevating the heat treatment temperature to a high temperature, but the core loss is also increased by elevating the heat treatment temperature. In view of the above, in the present invention, control for the magnetic permeability in a relatively low temperature region is attained as described below.

Figure 1:
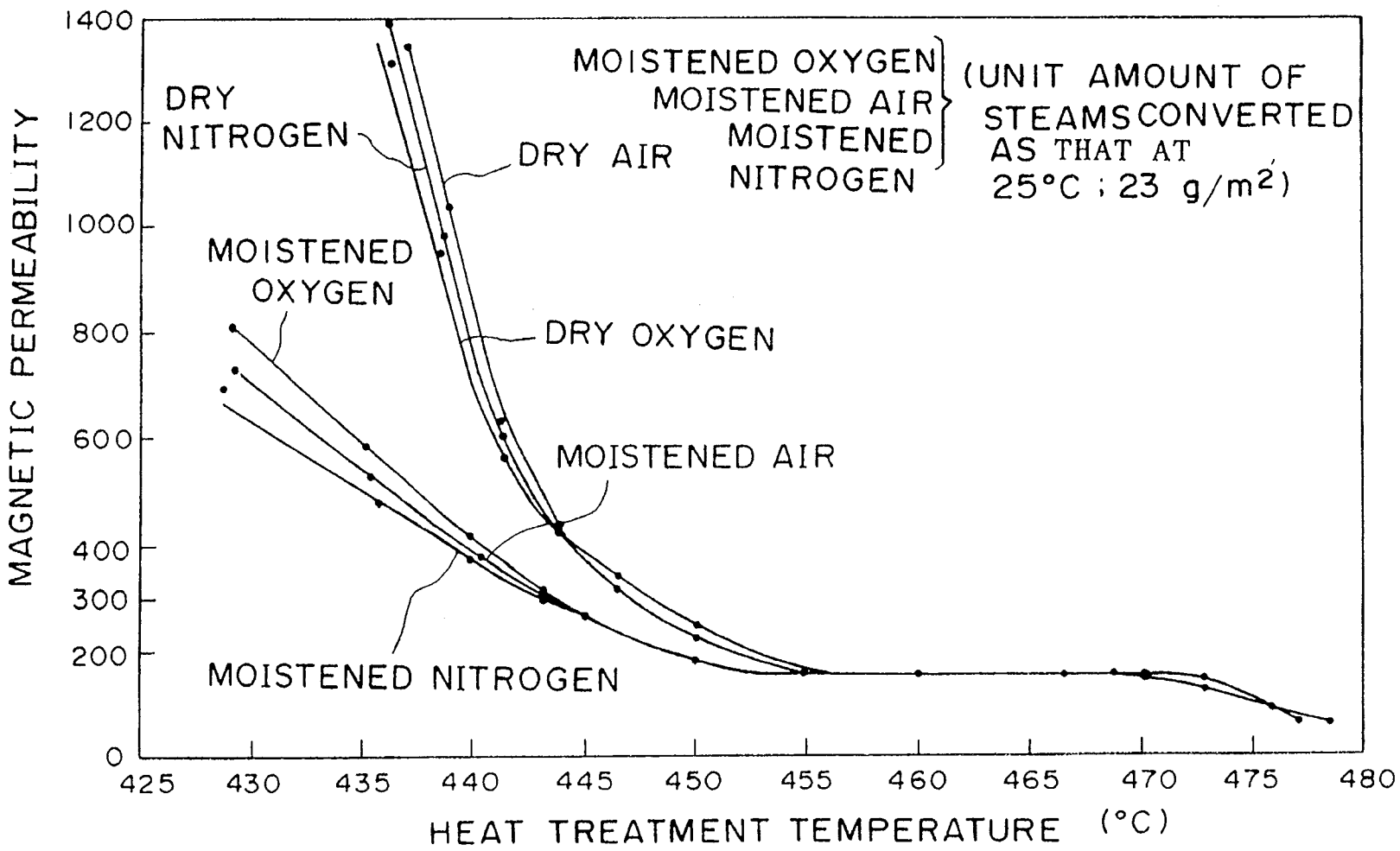
FIG. 1 is a graph illustrating a relationship between the heat treatment temperature and the magnetic permeability in each of the heat processing atmospheres in the manufacturing method according to the present invention.
Figure 2:
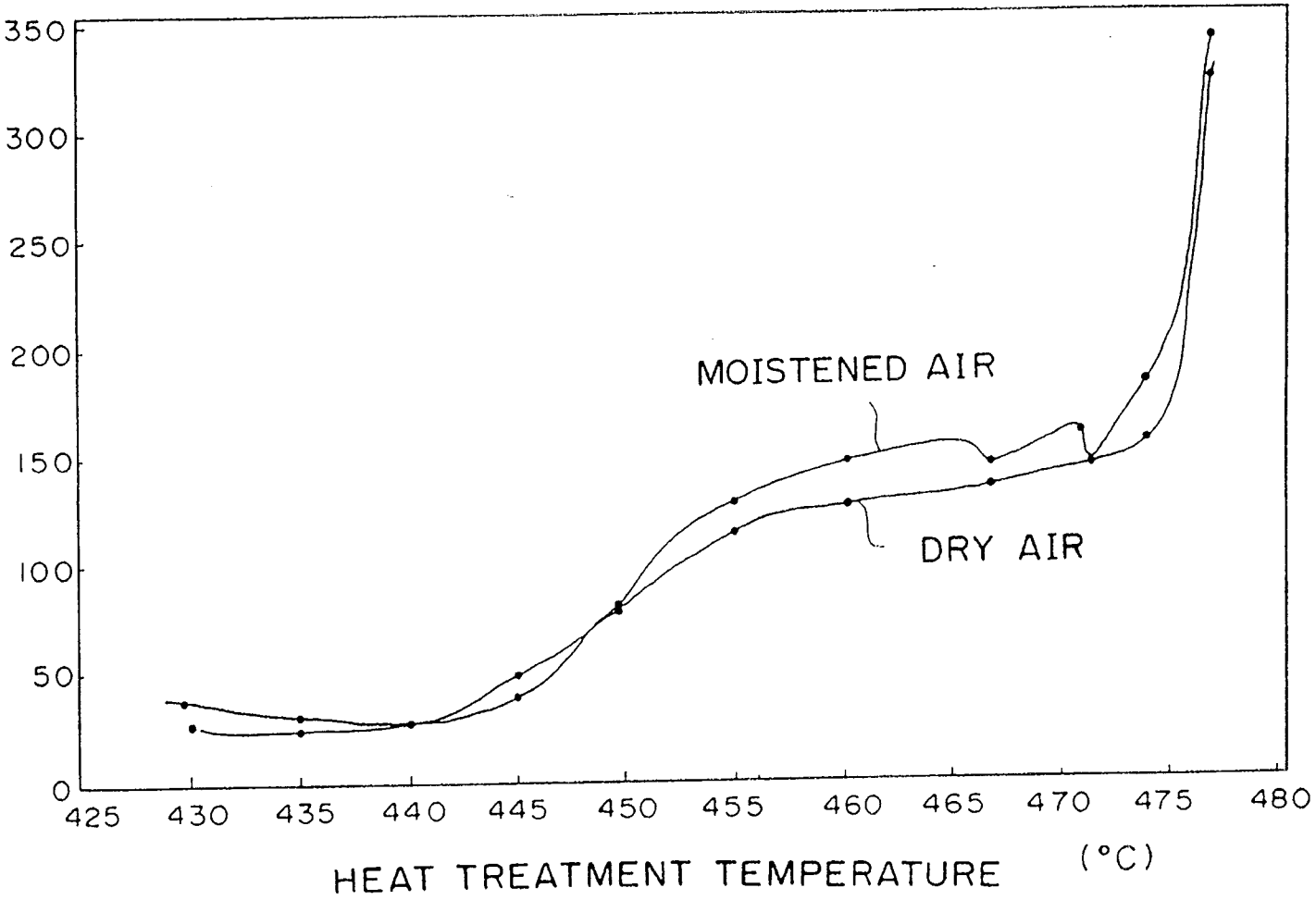
FIG. 2 is a graph illustrating a relationship between the heat treatment temperature and the core loss in each of the heat processing atmospheres in the manufacturing method according to the present invention.
Figure 3:
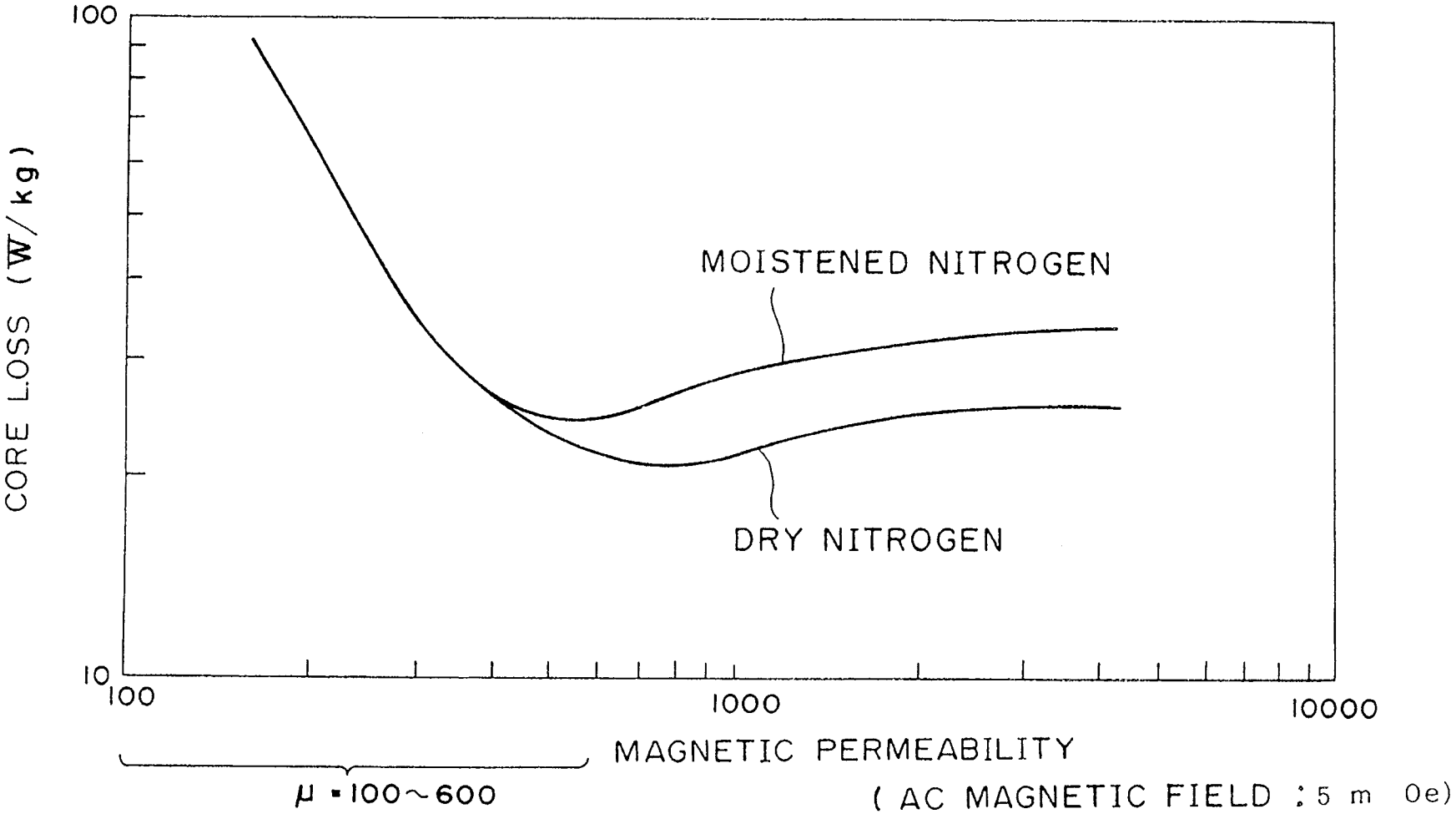
FIG. 3 is a graph illustrating a relationship between the magnetic permeability and the core loss in the manufacturing method according to tile present invention.
Figure 7:
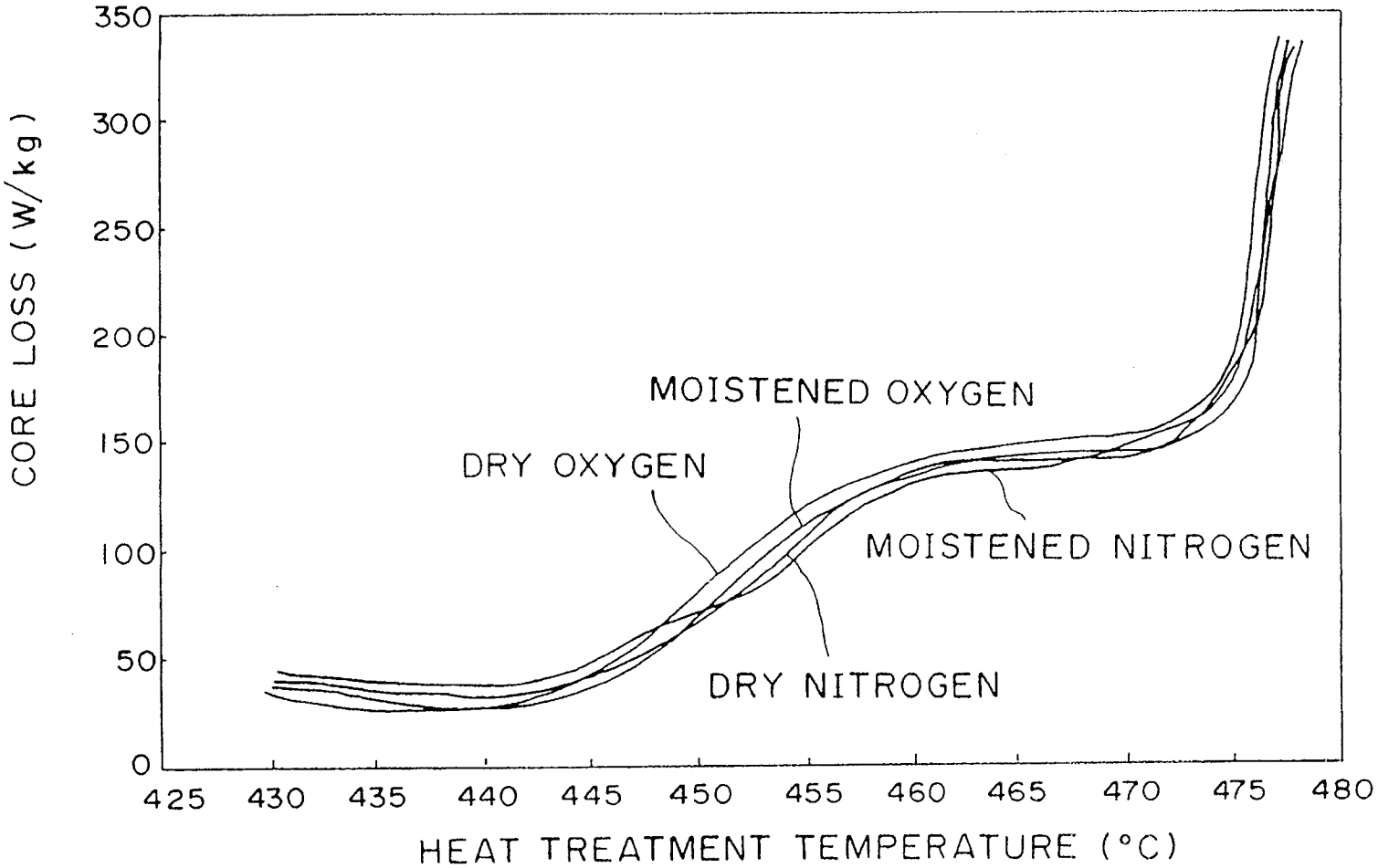
FIG. 7 is a graph illustrating a relationship between the heat treatment temperature and tile core loss in each of the treatment atmospheres in the manufacturing method according to tile present invention.
Figure 8:
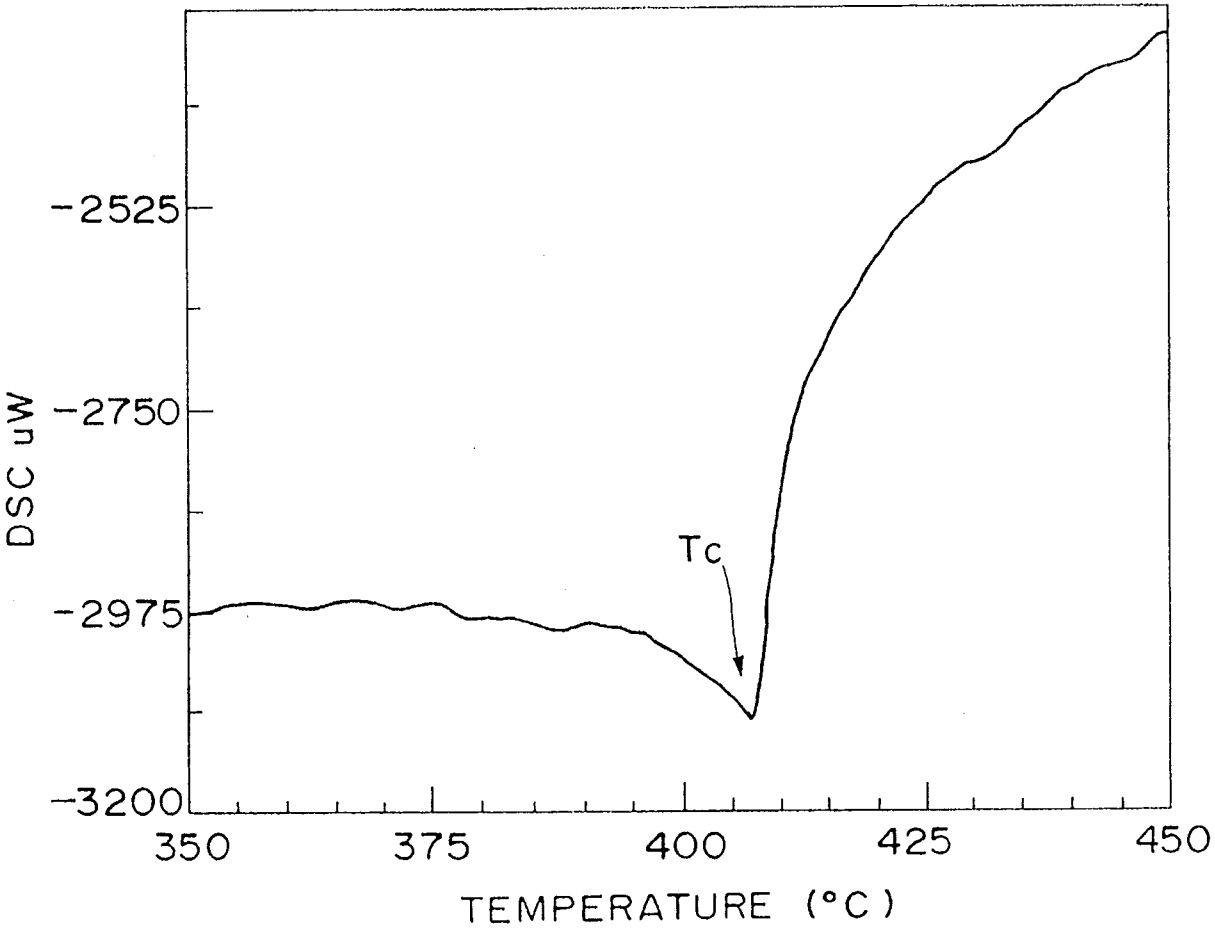
FIG. 8 is a graph illustrating the change of the differential scanning heat calorie measured by using a DSC device in the examples of the heat treatment method (A) according to the present invention.

FIG. 1 shows a relationship between the heat treatment temperature and the magnetic permeability in a case where a magnetic core main body obtained by winding a ferrous amorphous alloy ribbon which is as same as manufactured in the example 1 before heat treatment (having no gap) is treated in a dried state and a wet state (unit amount of steam; about 23 g/m$^3$converted as that at 25° C.) for each of air, oxygen and nitrogen atmospheres as the heat treatment atmosphere.

in this connection, the wet air, oxygen and nitrogen atmospheres shown in FIGS. 2, 3 and 7 are an air, oxygen and nitrogen in which a unit amount of steam converted as that at 25° C. is in a state of 23 g/m$^3$, respectively.

The magnetic, permeability meant here was measured under the conditions of an AC magnetic field of 100 kHz, 5 m0e and a DC magnetic field of 00e by using precision LCR meter HP4284A manufactured by Hewlett Packard Ltd. The constancy of magnetic permeability when the DC magnetic field is superimposed can be estimated by determining the magnetic permeability. The range of the magnetic permeability capable of obtaining a preferred constancy of magnetic permeability is from 150–600.

As can be seen from the figure, the magnetic permeability can be suppressed in a relatively low temperature region lower than 450° C. (2 hours) in a case where the heat treatment is applied in a so-called wet atmosphere.

In the present invention, since the magnetic main body is treated in a wet atmosphere containing a unit amount of steam of 5–500 g/m$^3$, preferably 8–200 g/m$^3$, more preferably 10–80 g/m$^3$, most preferably 20–80 g/m$^3$ converted as that at 25° C., the magnetic permeability of tile magnetic core can be suppressed even in a case of applying the heat treatment in a relatively low temperature region and a stable constancy of magnetic permeability can be obtained for a wide temperature range.

FIGS. 2 and 7 show a relation between the heat treatment temperature and the core loss and FIG. 3 shows a relationship between the magnetic permeability and the core loss in each of the atmospheric conditions in the case when the magnetic core main body which was manufactured according to the embodiment 1 and before the heat treatment was used.

In FIGS. 2 and 7, change of the core loss to the heat treatment temperature is substantially identical in the dry atmosphere and in the wet atmosphere, showing that heat treatment applied in the wet atmosphere does not increase the core loss as compared with the heat treatment applied in the dry atmosphere.

Further, it can be seen from FIG. 3 that the core loss is increased more in the wet atmosphere than in the dry atmosphere within a range in which the magnetic permeability exceeds 600. However, in a so-called low magnetic permeability region within a range of tile magnetic permeability of about 100 to 600 capable of attaining the constancy of magnetic permeability aimed in the present invention, there is no degradation in the core loss at all as compared with that in the dry atmosphere.

In the manufacturing method according to the present invention, for controlling tile magnetic permeability of the magnetic core on the side of the low temperature region, obtaining the constancy of magnetic permeability over a wide temperature range and preventing the degradation of the core loss, the heat treatment temperature T is preferably within a range represented by the following equation 1, more preferably in the range of the following equation 2.

$$Tx-5^\circ\text{ C.} \geqq T \geqq Tx-100^\circ\text{ C.} \quad (1)$$

$$Tx-20^\circ\text{ C.} \geqq T \geqq Tx-65^\circ\text{ C.} \quad (2)$$

In the equations 1 and 2, $T_x$ represents the crystallization temperature of the amorphous alloy.

The heat treatment temperature T is defined by using the crystallization temperature Tx as shown by the equations 1 and 2 because the constancy of magnetic permeability is deteriorated on the side of the lower temperature than that described above (lower than Tx−100° C.), while the core loss is increased on the side of the higher temperature (higher than Tx−5° C.) than that described above. In the present invention, it is preferred to perform within the range of equation 2 so as to obtain good magnetic permeability and less core loss.

The crystallization temperature Tx in this case was determined as a crossing point between an extension from a heat generation peak curve measured for 10 mg specimen at a heating rate of 10° C./min in an $N_2$ atmosphere toward the high temperature side of the base line on the low temperature side of the heat generation peak at the lowest temperature and a tangential line drawn at a point at which the slope of the outgoing line on the low temperature side of the heat generation peak reaches maximum. There is no particular restriction for the heat treatment time but 1 minute to 20 hours is preferred, more preferably 30 min. to 3 hours.

The range for the optimum heat treatment temperature varies depending on the alloy compositions, and the optimum heat treatment temperature range when using 2605S-2 ($Fe_{78}B_{13}Si_9$ (atomic %) : Tx=501° C.), which is an amorphous alloy manufactured by Allied Co., is from 496° C. to 401° C., preferably, 481° C. to 436° C.

Figure 4:
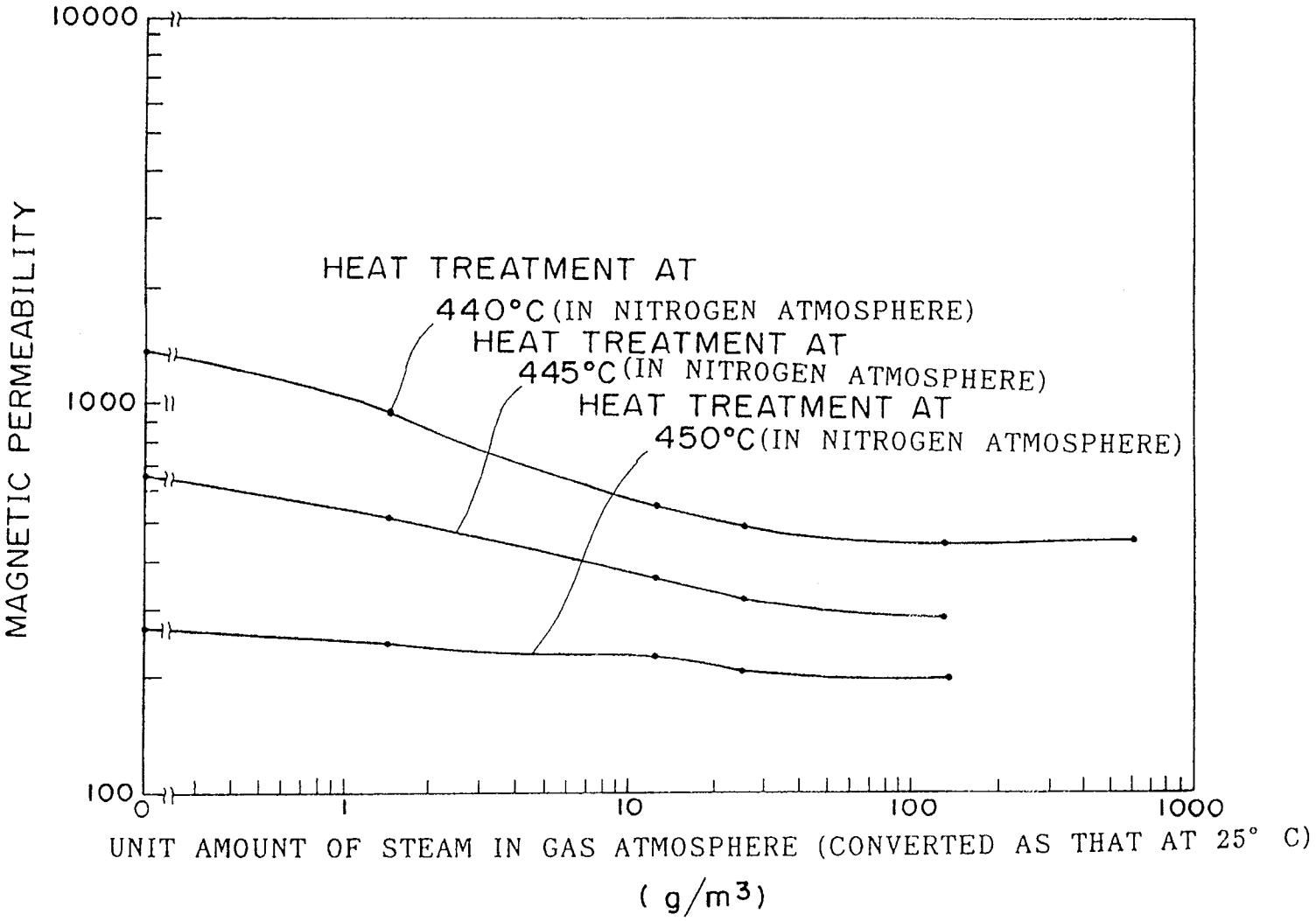
FIG. 4 is a graph illustrating a relationship between the magnetic permeability and the amount of steam in the manufacturing method according to the present invention.

FIG. 4 shows a relationship between the magnetic permeability and the unit amount of steam using a magnetic core main body manufactured in accordance with the example 1 which was heat treated in the nitrogen atmosphere wherein the unit amount of steam converted as that of 25° C. is changed. As can be seen from the figure, the magnetic Permeability can be suppressed with smaller amount of steam as the treating temperature is lower. That is, it has been found that a stable constancy of magnetic permeability can be obtained by introducing the wet atmosphere in such a low temperature region.

When manufacturing magnetic core after heat treated magnetic ribbons, it is not always possible to obtain stable products even when heat treatment conditions are determined. The inventors of the present invention have noticed that magnetic ribbons provided as blank lots have scatterings in the characteristics. Further, many solutions for the problems have been examined and they found that a magnetic core with stable characteristics of products constant at a good yield even if there are, such scattering can be provided by determining an optimum temperature for a heat treatment as described in the following methods.

In the heat treating method according to the present invention, a magnetic ribbon is optionally sampled from blank lots before heat treatment, a portion of the magnetic ribbon is cut out as the specimen, and measurement was conducted by using a DSC (Differential Scanning Calorlmetry) device (A) the curie temperature, (B) the differentiated crystallization temperature or (C) the crystallization peak temperature.

Then, in case of (A), the optimum temperature for heat treatment was determined by comparing the value of the measured temperature with a curie point corresponding to the heat treatment temperature for a previously prepared aimed magnetic permeability, thereby determining an optimum value for the heat treatment temperature (hereinafter referred to Method A).

In case of (B), the optimum temperature for heat treatment is determined by comparing tile value of the measured temperature with a differentiated crystallization temperature corresponding to tile heat treatment temperature for a previously prepared aimed magnetic permeability thereby determining an optimum value for the heat treatment temperature (hereinafter referred to Method B).

In case of (C), the optimum temperature for heat treatment is determined by comparing the value of the measured temperature with .a crystallization peak temperature corresponding to the heat treatment temperature for a previously prepared aimed magnetic permeability thereby determining an optimum value for the heat treatment temperature (hereinafter referred to Method C).

The differentiated crystallization temperature in the method (B) is defined as a temperature at which the change of the differential scanning heat calorie in the positive direction reaches the maximum upon crystallization of amorphous.

That is, it can be obtained from a curve obtained by differentiating a DSC (Differential Scanning Calorimetry) curve with time upon crystallization.

The crystallization peak temperature (Tx) may sometimes appear at two positions and, in this case, it is defined that the differentiated crystallization temperature of the first crystallization temperature as a first differentiated crystallization temperature ($Tx_{1d}$) and the differentiated crystallization temperature of the second crystallization temperature as the second differentiated crystallization temperature ($Tx_{2d}$).

Figure 6:
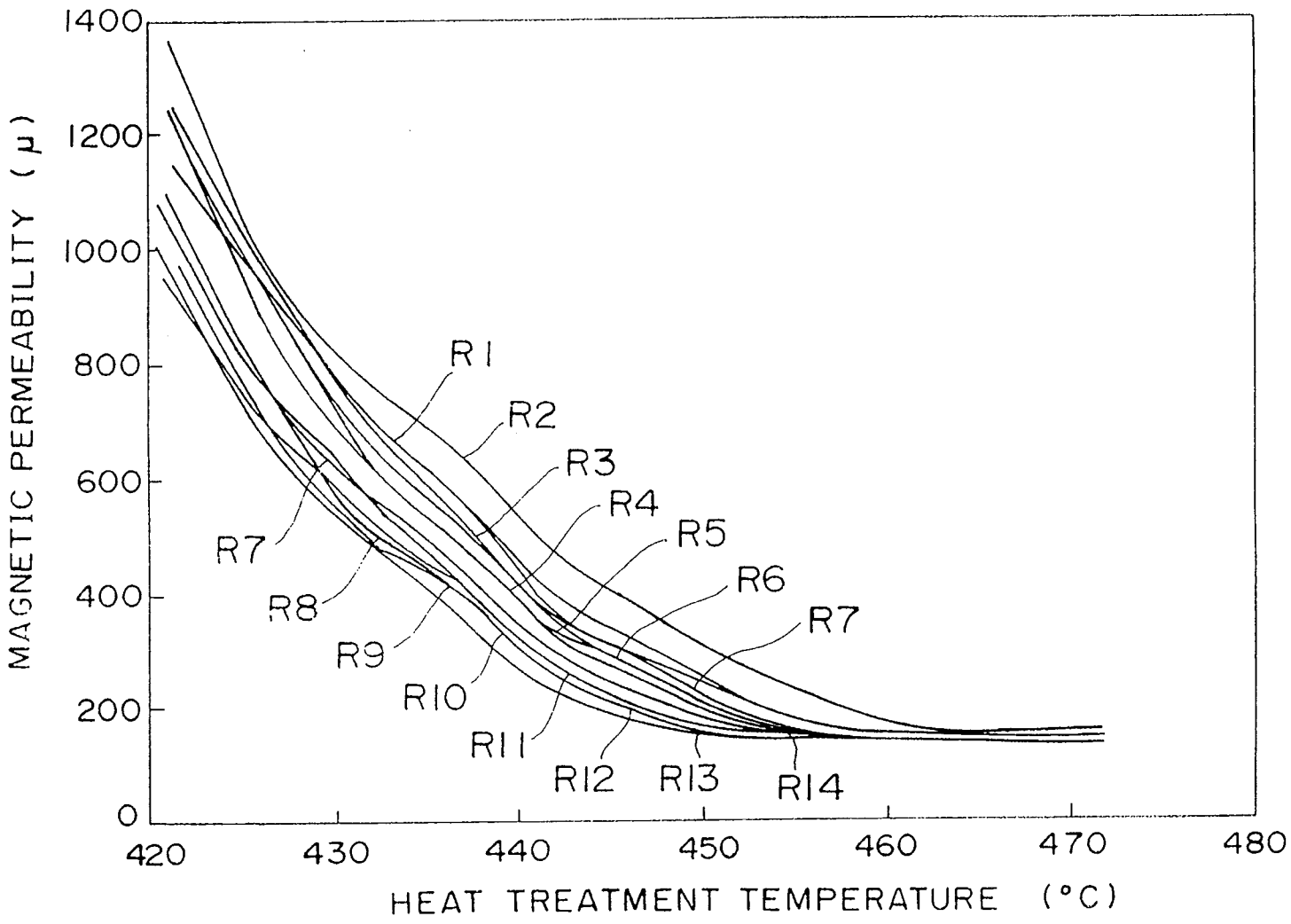
FIG. 6 is a graph showing a relationship between the heat treatment temperature and tile scattering of tile magnetic permeability on every lots of magnetic ribbons.

Further, the crystallization temperature in the method (C) can be obtained by using the method of measuring the crystallization temperature of an amorphous metal as described in Japanese Industrial Standards (JIS-H7151). In addition, there can be also mentioned measuring methods for the crystallization temperature, For example, temperature change of electric resistance, temperature change caused by thermal expansion and temperature change in X-ray diffraction. Among them, a method of determining the crystallization peak temperature by using a DSC (Differential Scanning Calorimetry) device is convenient and can determine the crystallization temperature at a high accuracy and good reproducibility. In each heat treatment methods, FIG. 6 shows a relationship between the heat treatment temperature and the magnetic permeability for 14 samples (R1–R14) optionally sampled from respective blank lots of the magnetic ribbon. In the figure, the heat treatment was applied in atmospheric air and the heat treatment time was two hours. The method of measuring the magnetic permeability has already described.

As can be seen in FIG. 6, in a ease of applying a heat treatment under the temperature condition of 445° C. for 2 hours, magnetic cores with the magnetic permeability ranging from 180–380 around 250 are formed simultaneously. That is, even when the temperature condition is controlled strictly, the resultant magnetic cores have a possibility of causing a difference in the magnetic permeability of 200 at the maximum and the yield may be extremely worsened.

Accordingly, a second object of the present invention is to provide, taking notice on that magnetic ribbons provided as blank lots have scatterings in the characteristics, a magnetic core with stable characteristics of products constant, at a good yield even if there are such scatterings.

Description will now be made more specifically to each of the methods (A), (B) and (C).

Figure 9:
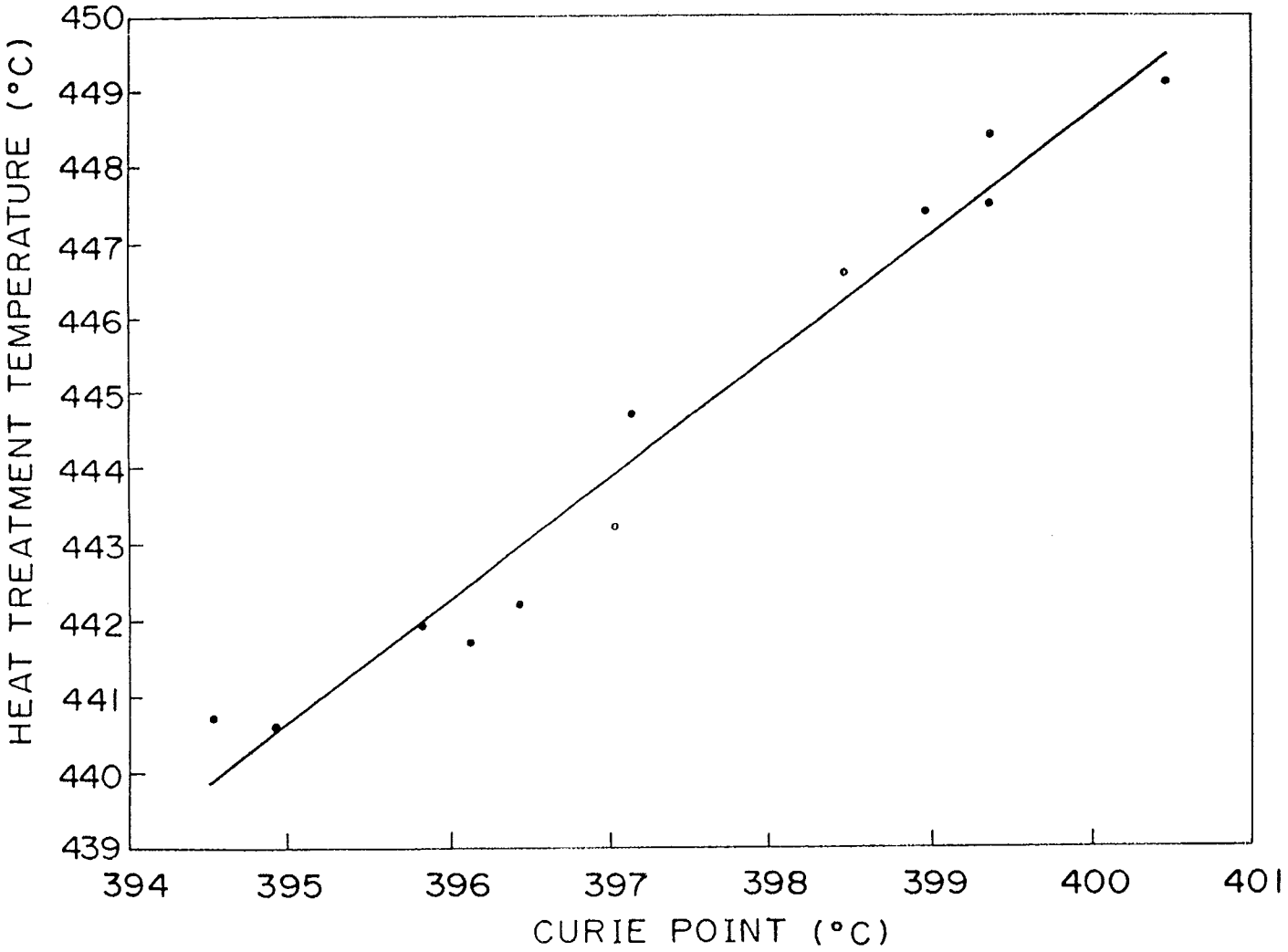
FIG. 9 is a graph illustrating tile change of the heat treatment temperature to tile curie temperature at a magnetic permeability of 250 in the heat treatment method (A) according to the present invention.

Method (A):

FIG. 9 shows the change of the differential scanning heat caloric (DSC) when the magnetic ribbon is weighted by 20 mg as a specimen and measured by DSC device. It can be seen from the figure that the curie point (Tc) of the magnetic ribbon is 407° C.

Then, the controlled temperature for the heat treatment is determined by substituting the measured temperature value from tile DSC device for the equation defining the heat treatment temperature and the curie point in the previously measured aimed magnetic permeability.

The above-mentioned equation can be derived, for example, as shown below.

The equation can be obtained by sampling the relationship between the heat treatment temperature and the curie temperature in the aimed magnetic permeability by means of a plurality of lot blanks previously.

Figure 10:
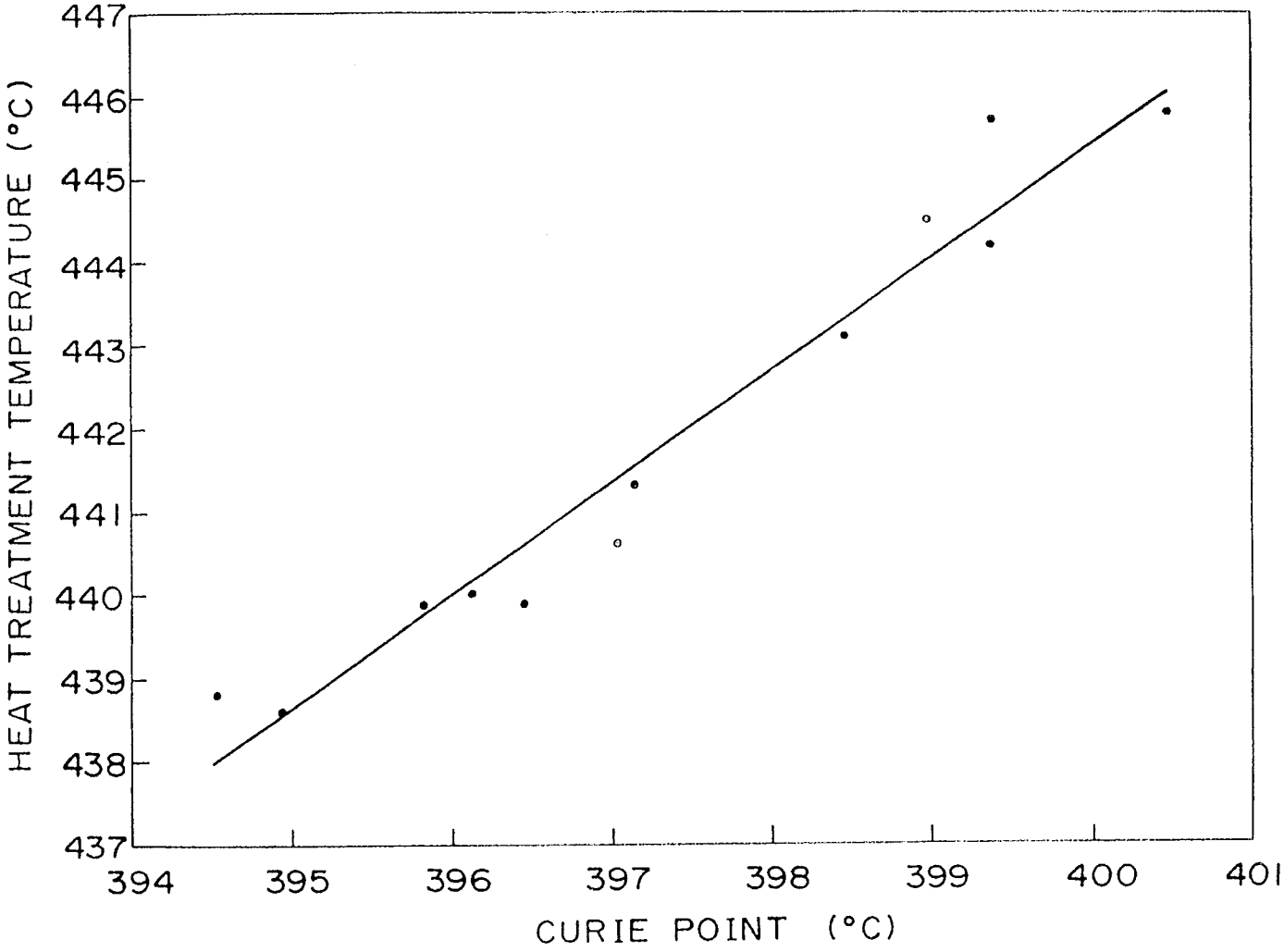
FIG. 10 is a graph illustrating the change of the heat treatment temperature to tile curie temperature at a magnetic permeability of 300 in the heat treatment method (A) according to the present invention.

FIG. 9 illustrates the change of the heat treatment temperature to the curie point at a magnetic permeability of 250, while FIG. 10 illustrates the change of the heat treatment temperature to the curie point at a magnetic permeability of 300.

It can be seen from both of tile figures that there is an intense positive correlation between the curie temperature and the heat treatment temperature, from which the following equation can be derived by the least square method.

$$T(^\circ\text{ C.}) = 1.634 \times Tc(^\circ\text{ C.}) - 204.77 \quad 3$$

$$T(^\circ\text{ C.}) = 1.363 \times Tc(^\circ\text{ C.}) - 99.88 \quad 4$$

In the equation 3, T represents tile control temperature for heat treatment capable of obtaining tile aimed magnetic permeability (for example, 250), while Tc represents the curie temperature obtained From the DSC device, and the correlation efficient is 0.988.

For the control of the heat treatment temperature, it may be considered specifically to control an electric furnace stepwise, for example, by about 1° C. within a range 440° C. –460° C., based on the control temperature for the heat treatment (T) obtained on every blank lots.

The temperature control for tile electric furnace is conducted based on the control temperature for tile heat treatment (T) thus determined by tile equation 3, and heat treatment (annealing) at an optimal heat treatment control temperature for obtaining the aimed magnetic permeability is conducted on every predetermined blank lots.

Method (B)

Figure 11:
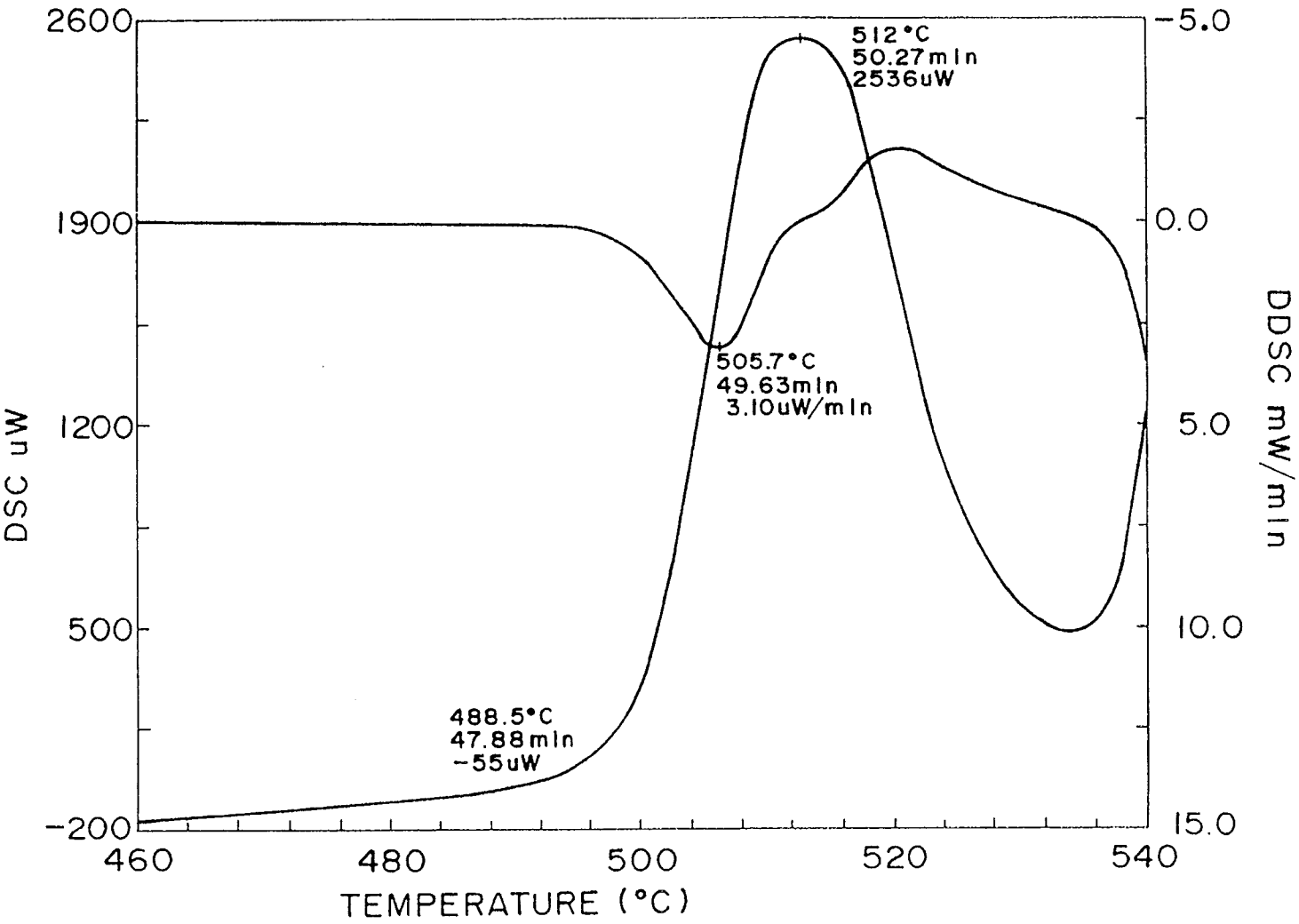
FIG. 11 is a graph illustrating the change of the differential scanning heat calorie and the change of the differentiated crystallization temperature measured by using a DSC device in the examples of the heat treatment method (B) according to the present invention.

FIG. 11 shows the change of tile differential scanning heat calorie obtained by weighing the magnetic ribbon by 10 mg as the specimen and measuring by using tile DSC device and, from the figure, tile first differentiated crystallization temperature ($Tx_{1d}$) can be found.

Then, tile measured temperature value from the DSC device is substituted for tile equation between tile heat treatment temperature and the first differentiated crystallization temperature ($Tx_{1d}$) in tile previously measured aimed magnetic permeability to determine the temperature for the heat treatment.

The above-mentioned equation can be derived as shown below.

Such equations can be obtained, for example, by previously sampling tile relationship between the heat treatment temperature and the first differentiated crystallization temperature ($Tx_{1d}$) in tile aimed magnetic permeability by means of a plurality of lot blanks.

Figure 12:
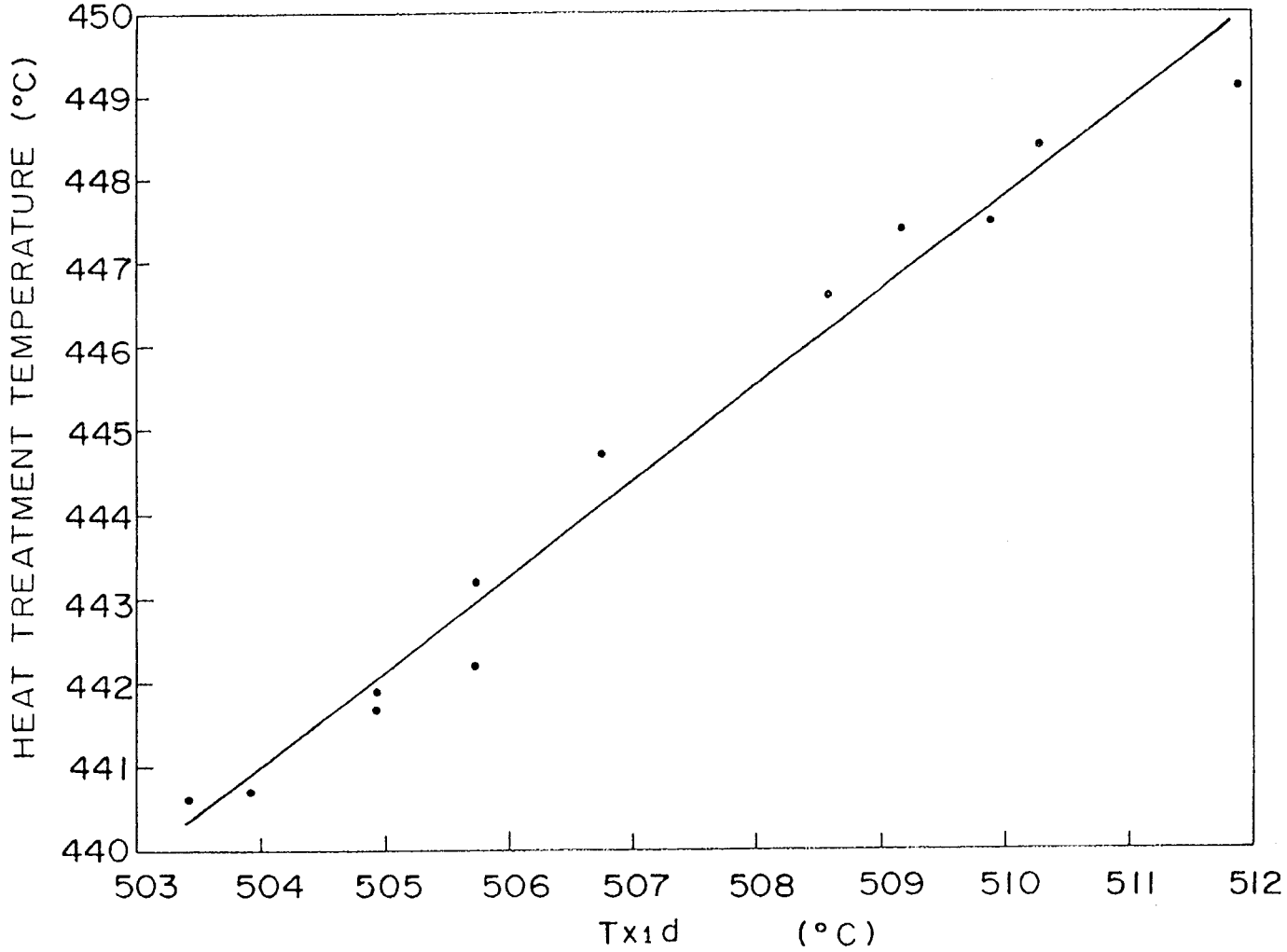
FIG. 12 is a graph illustrating tile change of the heat treatment temperature to the differentiated crystallization temperature at a magnetic permeability of 250 in tile heat treatment method (B) according to the present invention.
Figure 13:
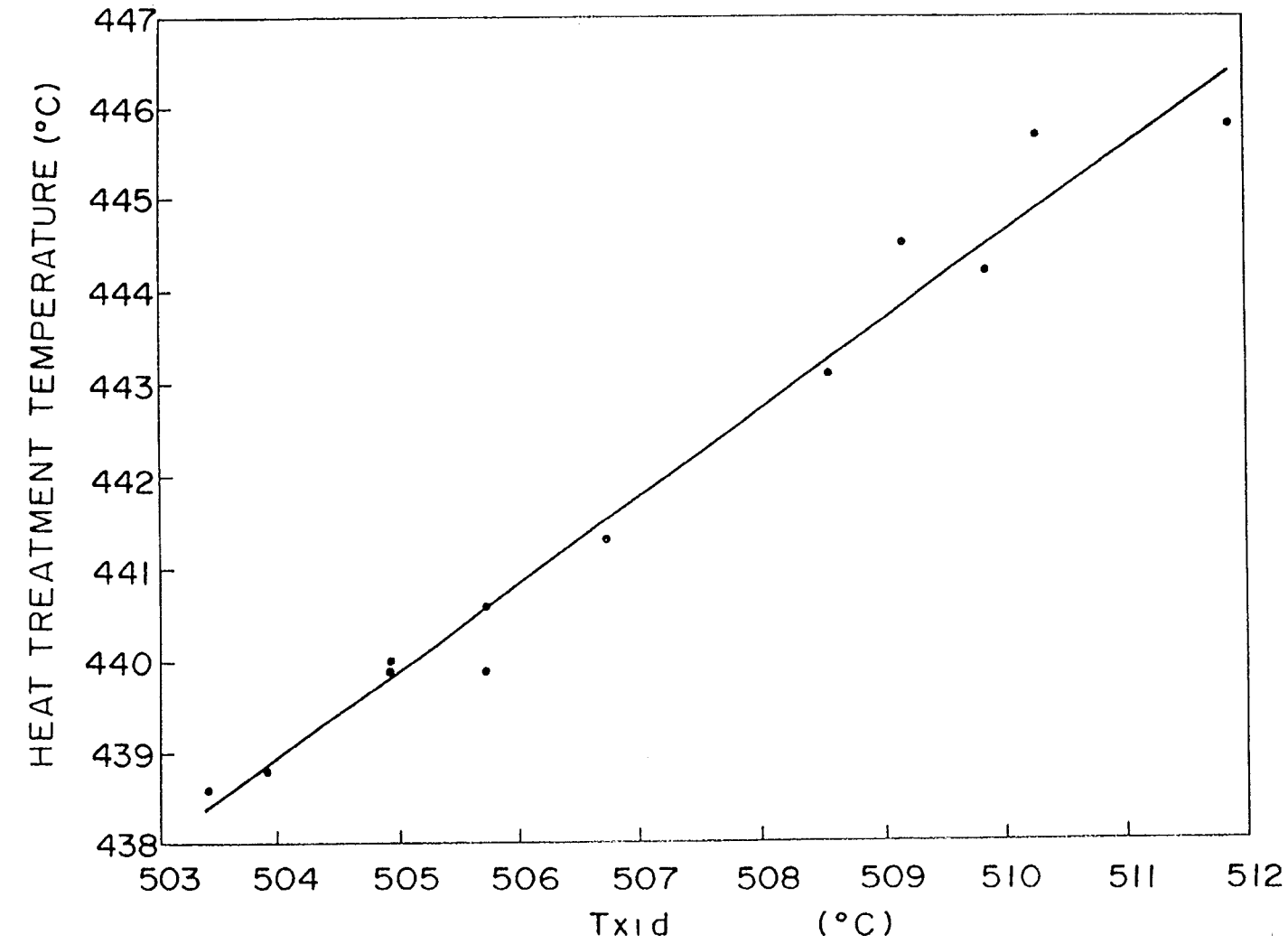
FIG. 13 is a graph illustrating the change off the heat treatment temperature to tile differentiated crystallization temperature at a magnetic permeability of 300 in tile heat treatment method (B) according to the present invention.

FIG. 12 shows the change of the heat treatment temperature to the differentiated crystallization temperature at a magnetic permeability of 250, while FIG. 13 shows the change of the heat treatment temperature to tile differentiated crystallization temperature at a magnetic permeability of 300.

As can be seen from both of the Figures, there is an intense positive co relationship between the differentiated crystallization temperature and the heat treatment temperature, from which the following equations 5 and 6 can be derived by means of the least square method. Equation 5 shows a case of for the magnetic permeability of 250, while equation 6 shows a case for the magnetic permeability of 300.

$$T(^\circ\text{ C.})=1.149Tx_{1d}-138.43 \quad 5$$

$$T(^\circ\text{ C.})=0.935Tx_{1d}-41.49 \quad 6$$

In the equations 5 and 6, T represents a control temperature for the heat treatment capable of obtaining the aimed magnetic permeability and $Tx_{1d}$ represents the first differentiated crystallization temperature. In each of the equations, the correlation function is 0.98 or more.

For the heat treatment temperature in tile electric furnace, the electric furnace is controlled each by 1° C., based on tile control temperature For the heat treatment (T).

In this way, heat treatment is conducted while controlling the electric furnace by the control temperature for the heat treatment determined based on the equations 5 and 6.

Method (C)

Figure 14:
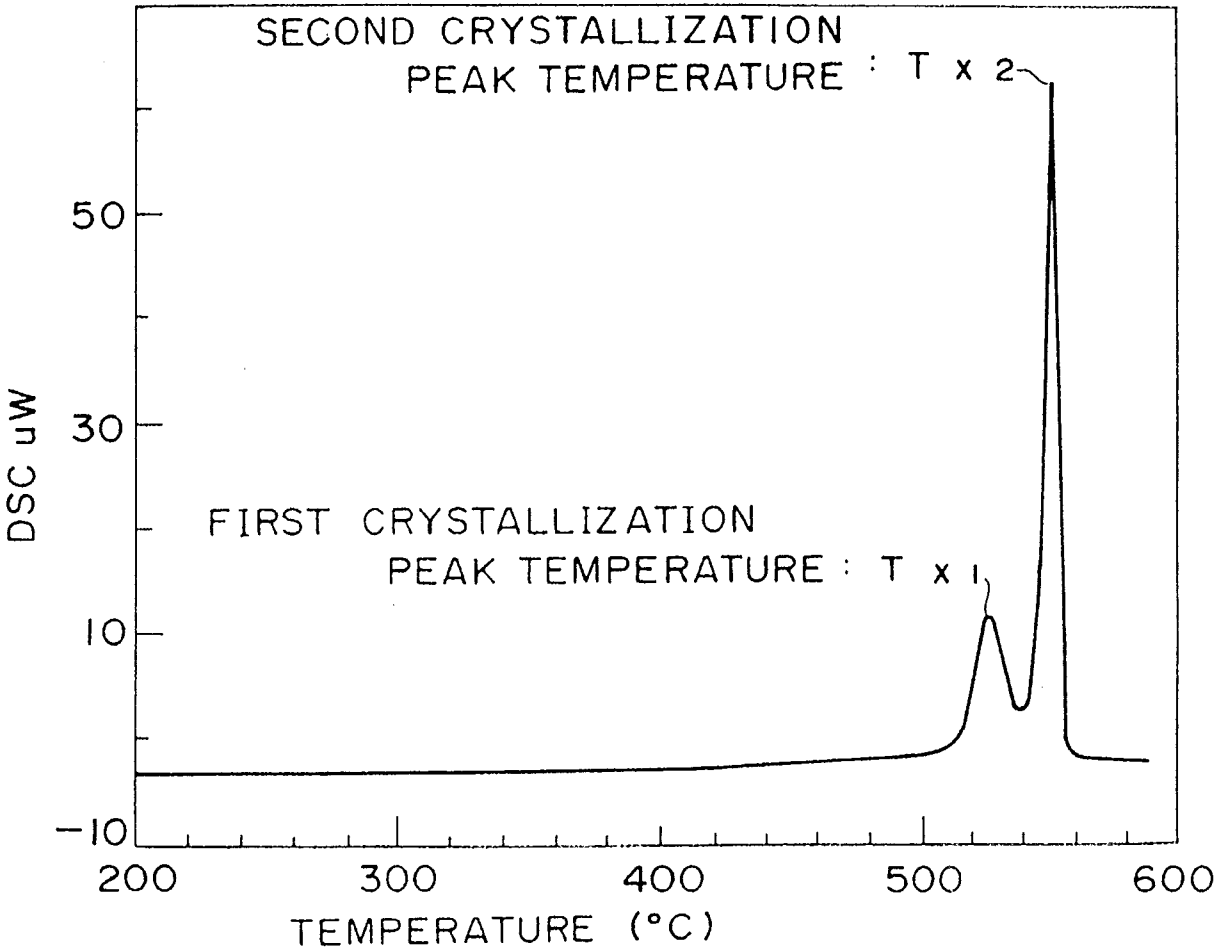
FIG. 14 is a graph illustrating the change of the differential scanning heat calorie measured by using a DSC device in the examples of the heat treatment method (C) according to the present invention.

FIG. 14 shows the change of the differential scanning heat calorie obtained by weighing the magnetic ribbon by 20 mg as the sample and measuring by using the DSC device and the crystallization heat generating peak temperature (Tx) can be seen from the figure.

Then, the measured temperature value from the DSC device is substituted for the equation representing the relation between the heat treatment temperature and the crystallization peak temperature (Tx) in the previously measured aimed magnetic permeability, to determine the heat treatment temperature.

The above-mentioned equations can be derived, for example, as shown below.

Such equations can be obtained, for example, by previously sampling the relationship between the heat treatment temperature and the crystallization peak temperature in the aimed magnetic permeability by means of a plurality of lot blanks.

Figure 15:
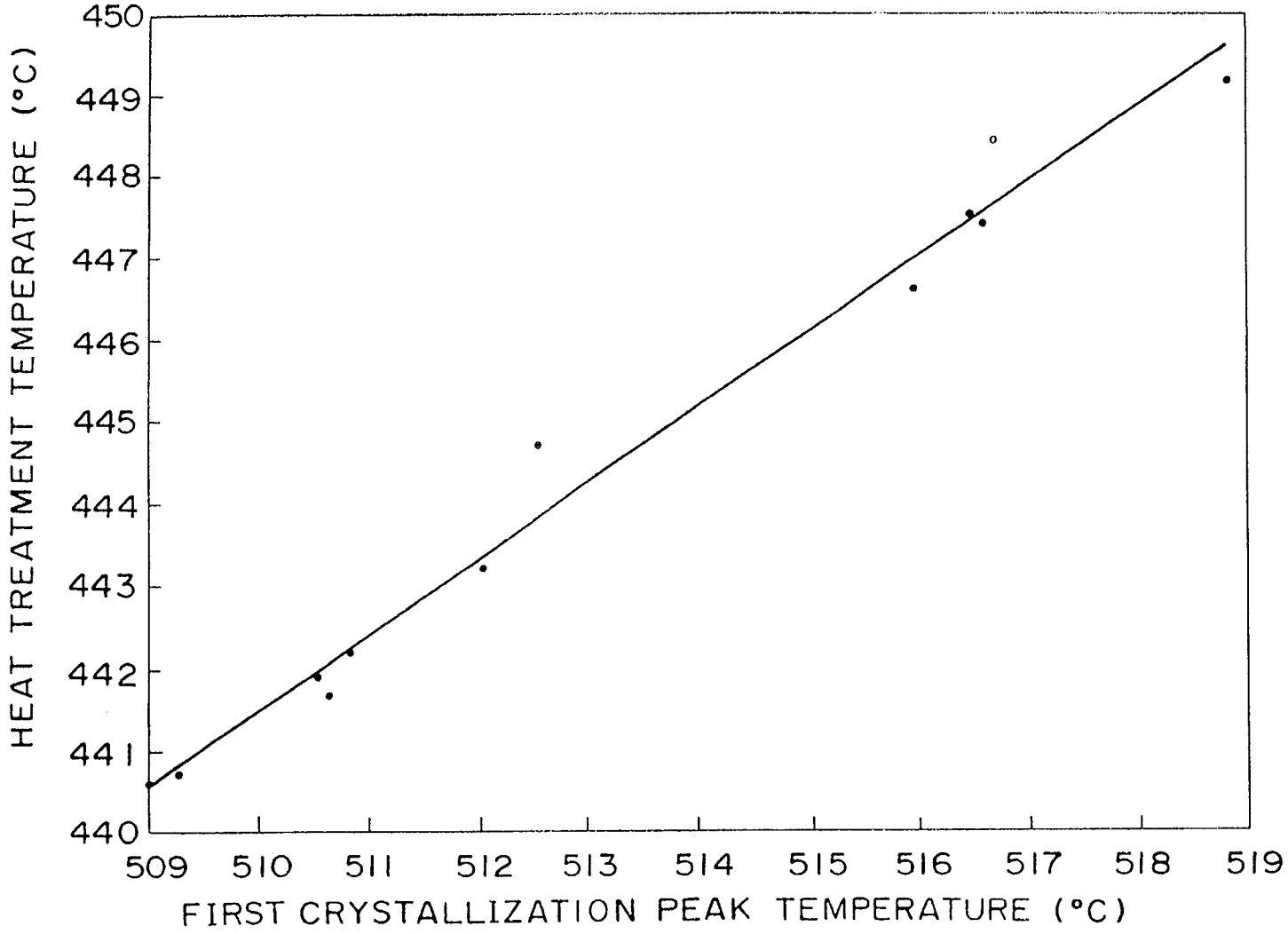
FIG. 15 is a graph illustrating the change of the heat treatment temperature to the crystallization peak temperature at a magnetic permeability 250 in the heat treatment method (C) according to the present invention.
Figure 16:
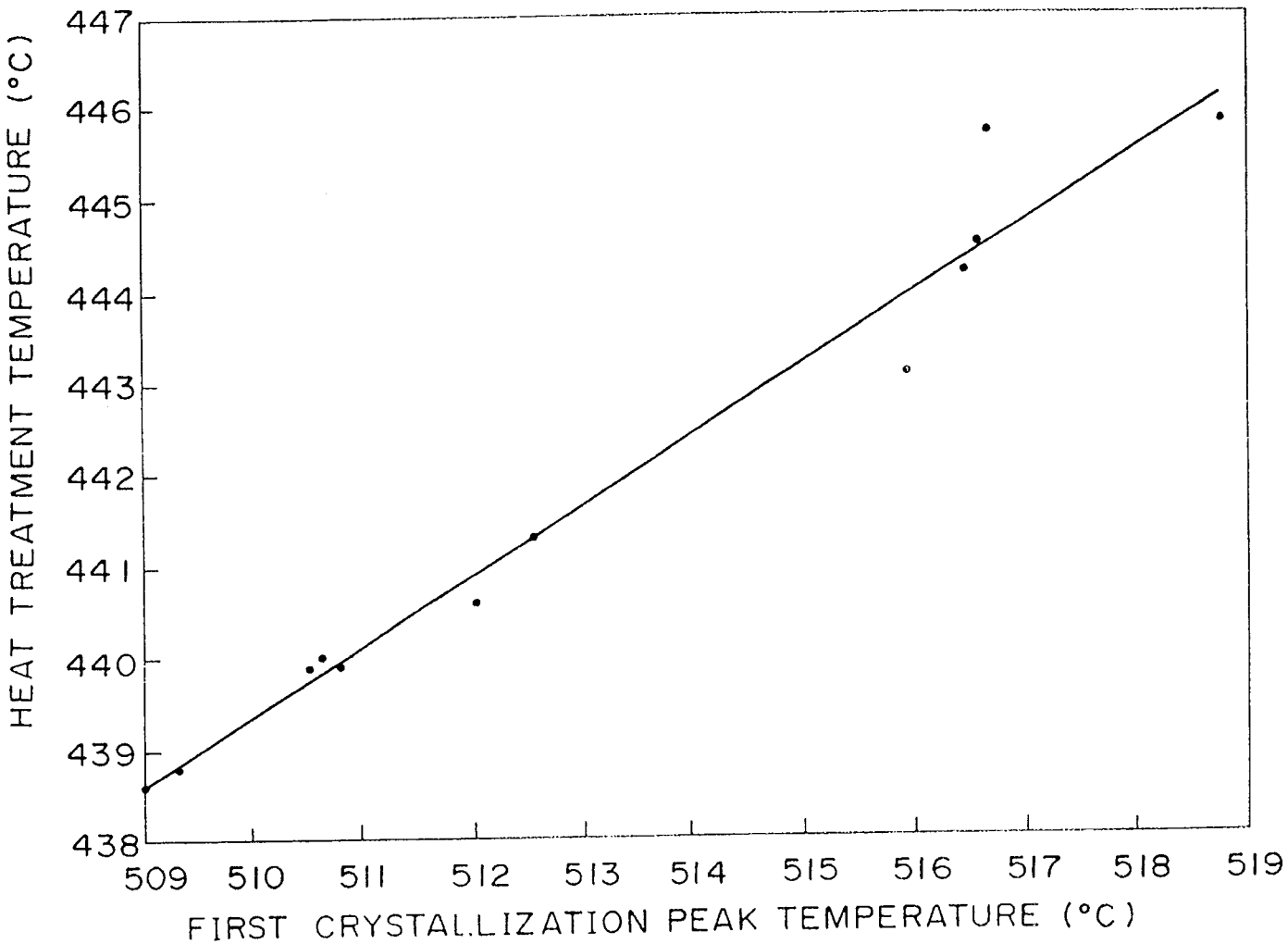
FIG. 16 is a graph illustrating the change of the heat treatment temperature to the crystallization peak temperature at a magnetic permeability of 300 in the heat treatment method (C) according to the present, invention.

FIG. 15 shows the change of the heat treatment-temperature to the crystallization peak temperature at a permeability of 250, while FIG. 16 shows the change of the heat treatment temperature to the crystallization peak temperature at a permeability of 300.

As can be seen from both of the figures, there is an intense positive correlationship between the crystallization peak temperature and the heat treatment temperature, from which the following equation 7, preferably, equation 8 can be derived by means of the least square method.

$$T(^\circ\text{ C.})=0.928Tx1-31.86 \quad 7$$

$$T(^\circ\text{ C.})=0.766Tx1+49.06 \quad 8$$

In the equations 7 and 8, T represents a control temperature for the heat treatment capable of obtaining the aimed magnetic permeability and Tx1 represents the first crystallization peak temperature in FIG. 15. In each of the equations, the correlation coefficient is 0.98 or more.

For the heat treatment temperature in the electric furnace, the electric furnace is controlled each by 1° C., based on the control temperature for the heat treatment (T).

In this way, the heat treatment is applied for controlling the electric furnace by the control temperature for the heat treatment determined based on the equations 7 and 8.

The present invention will now be described with reference to examples.

Example 1 (Example for the Magnetic Core Manufacturing Method)

A toroidal magnetic core main body 25 mm in outer diameter and 15 mm in inner diameter obtained by winding an amorphous ribbon manufactured by Allied Co. (trade name: Metglass, product No.: 2605S-2, composition: $Fe_{78}B_{13}Si_9$ (atomic %), thickness: 21 μm, width: 10 mm) was annealed in an electric furnace at a treating temperature of 445° C. for 2 hours. In this case, a wee atmosphere containing 25 g/m$^3$ of unit amount of steam converted as that at 25° C. in a nitrogen gas was used as the annealing atmosphere. Then, the magnetic core main body was contained without forming a gap into a case made of a synthetic resin to form a magnetic core.

Figure 17:
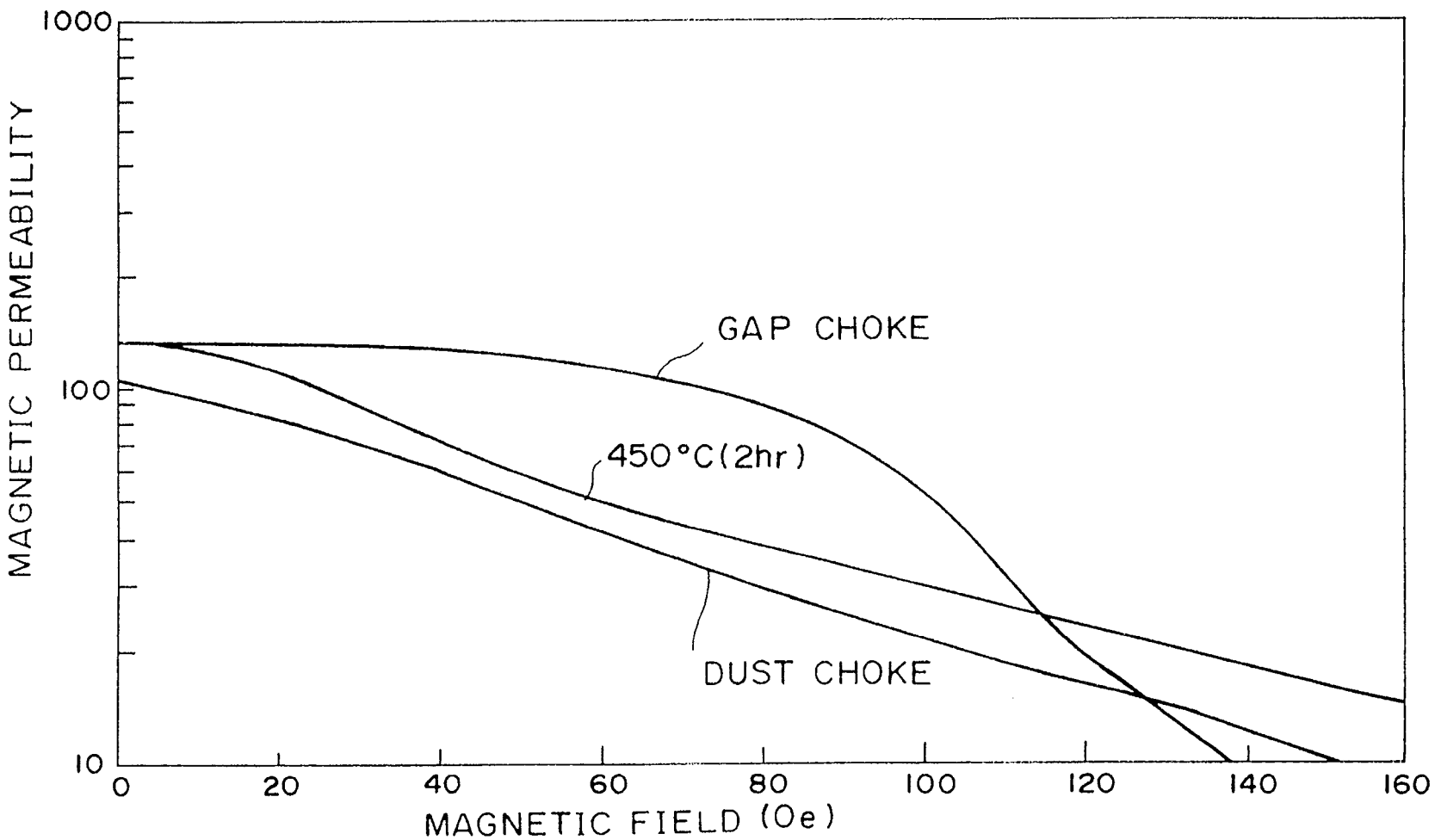
FIG. 17 is a graph illustrating the DC-superimposed magnetic field characteristic in comparison between a gap choke and a dust choke in Example 1 of the manufacturing method according to the present invention.

For the magnetic core, the relation between the magnetic permeability and the DC-superimposed magnetic field is shown in FIG. 17.

In the figure, each of the characteristics for a gap choke obtained under the same conditions as those for the magnetic core described above and a dust choke obtained by molding the compression powder of sawdust were also plotted for the comparison.

As can be seen from the figure, the magnetic core obtained in this Example had a characteristic similar to that of the dust choke and could obtain a higher magnetic permeability over the entire superimposed portion than that of tile dust choke. Further, it showed no abrupt reduction of the magnetic permeability at 100 (0e) or less as in the case of the gap choke.

Example 2 (Example for the Heat Treatment Method (A) for the Magnetic Core)

The same amorphous ribbon manufactured by Allied Co. as in Example 1 was wound to obtain a toroidal magnetic core main body 25 nun in outer diameter and 15 mm in inner diameter.

On the other hand, the curie point (Tc) was measured for the specimens optionally sampled from each of the product lots of the amorphous ribbons described above by using the DSC device.

Then, the measured value was substituted for the equation 3 to determine the control temperature (T) for the heat treatment and the electric furnace was controlled based thereon.

In this Example, the heat treatment temperature (T) of the electric furnace was controlled to 444° C. for the lot blank having a curie point (Tc) of 397.1° C.

As the heat treatment atmosphere, a nitrogen gas atmosphere was used and the heat treatment time was two hours.

As a result, those having the magnetic permeability ranging from 245 to 255 relative to the aimed magnetic permeability of 250 could be obtained at a yield of 97%.

After the completion of the heat treatment, the magnetic core main body was contained without forming a gap into a case made of a synthetic resin, to provide a magnetic core.

Example 3 (Example for tile Heat Treatment Method (A) for the Magnetic Core)

The same amorphous ribbon manufactured by Allied Co. as in Example 1 was wound to obtain a toroidal magnetic core main body 25 mm in outer diameter and 15 mm in inner diameter.

On the other hand, the curie point (Tc) was measured for the specimens optionally sampled from each of the product lots of tile amorphous ribbons described above by using the DSC device.

Then, the measured value was substituted for the equation 3 to determine the control temperature (T) for the heat treatment and the electric furnace was controlled based thereon.

In this Example, the heat treatment temperature (T) of the electric furnace was controlled to 446° C. for the lot blank with the curie point (Tc) of 400.4° C.

As the heat treatment atmosphere, a nitrogen gas atmosphere was used and the heat treatment time was two hours.

As a result, those having the magnetic permeability ranging from 290 to 300 relative to the aimed magnetic permeability of 300 could be obtained at a yield of 94%.

After the completion of the heat treatment, the magnetic core main body was contained without forming a gap into a case made of a synthetic resin, to provide a magnetic core.

Example 4 (Example for the Heat Treatment Method (B) for the Magnetic Core)

The same amorphous ribbon manufactured by Allied Co. as in Example 1 was wound to obtain a toroidal magnetic core main body 25 mm in outer diameter and 15 mm in inner diameter.

On the other hand, differentiated crystallization temperature ($Tx_{1d}$) was measured for the specimens optionally sampled from each of the product lots of tile amorphous ribbons described above by using the DSC device.

Then, the measured value were substituted for the equation 5 or 6 to determine the control temperature (T) for the heat treatment and tile electric furnace was controlled based thereon.

In this Example, the heat treatment temperature (T) of the electric furnace was controlled to 443° C. for the lot blank having the differentiated crystallization temperature ($Tx_{1d}$) of 505.7° C. As a result, those having the magnetic permeability ranging from 245 to 255 relative to the aimed magnetic permeability of 250 could be obtained at a yield of 99%.

After the completion of the heat treatment, the magnetic core main body was contained without forming a gap into a case made of a synthetic resin, to provide a magnetic core.

Example 5 (Example for the Heat Treatment Method (B) far the Magnetic Core)

The same amorphous ribbon manufactured by Allied Co. as in Example 1 was wound to obtain a toroidal magnetic core main body 25 mm in outer diameter and 15 mm in inner diameter.

On the other hand, the differentiated crystallization temperature ($Tx_{1d}$) was measured for the specimens optionally sampled from each of the product lots of the amorphous ribbons described above by using the DSC device.

Then, the measured value was substituted for the equation 5 or 6 to determine the control temperature (T) for heat treatment and the electric furnace was controlled based thereon.

In this case, the heat treatment temperature (T) of the electric furnace was controlled to 443° C. for the lot blank having the differentiated crystallization temperature ($Tx_{1d}$) of 508.5° C.

As a result, those having the magnetic permeability ranging from 290 to 300 relative to the aimed magnetic permeability of 300 can be obtained at a yield of 97%.

After the completion of the heat treatment, the magnetic core main body was contained without forming a gap into a case made of a synthetic resin, to provide a magnetic core.

Example 6 (Example for the Heat Treatment Method (C) for the Magnetic Core)

The same amorphous ribbon manufactured by Allied Co. as in Example 1 was wound to obtain a toroidal magnetic core main body 25 mm in outer diameter and 15 mm in inner diameter.

On the other hand, the crystallization peak temperature (Tx) was measured for the specimens optionally sampled from each of the product lots of the amorphous ribbons described above by using the DSC device.

Then, the measured value was substituted for the equation 7 or 8 to determine the control temperature (T) for heat treatment and the electric furnace was controlled based thereon.

In this case, the heat treatment temperature (T) of the electric furnace was controlled to 444° C. for the lot blank having the first crystallization temperature (Tx1) of 512.5° C. As a result, those having the magnetic permeability ranging from 245 to 255 relative to the aimed magnetic permeability of 250 can be obtained at a yield of 92%.

After the completion of the heat treatment, the magnetic core main body was contained without forming a gap into a case made of a synthetic resin, to provide a magnetic core.

Example 7 (Example for tile Heat Treatment Method (C) for the Magnetic Core)

The same amorphous ribbon manufactured by Allied Co. as in Example 1 was wound to obtain a toroidal magnetic core main body 25 mm in outer diameter and 15 mm in inner diameter.

On the other hand, tile crystallization peak temperature (Tx) was measured for tile specimens optionally sampled from each of the product lots of the amorphous ribbons described above by using the DSC device.

Then, the measured value was substituted for the equation 7 or 8 to determine the control temperature (T) for heat treatment and the electric furnace was controlled based thereon.

In this case, the heat treatment temperature (T) of the electric furnace was controlled to 445° C. for the lot blank with the first crystallization peak temperature (Tx1) of 516.5° C.

As a result, those having the magnetic permeability ranging from 290 to 300 relative to-the aimed magnetic permeability of 300 could be obtained at a yield of 90%.

As has been described above, in Examples 1–2, since the magnetic core main body made of an amorphous ribbon was applied with a heat treatment in tile wet atmosphere containing a limited amount of steam, a magnetic core having stable characteristics, particularly, in a low magnetic permeability region could be obtained at a high yield. Further, according to Examples 3–7, a particularly high yield could be obtained by compensating tile scattering in the blank lot with reference to the curie temperature, the differentiated crystallization temperature or the crystallization peak temperature in the heat treatment.

INDUSTRIAL APPLICABILITY

In the manufacturing method according to the present invention, a magnetic core having a low core loss and stable characteristics in a low magnetic permeability region can be provided by controlling the amount of steam in the heat treatment atmosphere.

Further, since the range for the temperature control can be widened by the heat treatment In the wet atmosphere, products of stable characteristics can be supplied even if there are more or less errors in the controlled temperature and, accordingly, productivity for the magnetic core can be improved.

According to each of the heat treatment methods of the present invention, magnetic cores of stable characteristics for the quality of the products can always be obtained even in a case where the magnetic ribbons before heat treatment which are provided as the blanks and have scatterings.

As preferred applicational uses for the magnetic core obtained according to the present invention, there can be mentioned, for example, a core of noise filters for smoothing ripple components superimposed on DC current or for normal mode use, as well as for active filters or a choke coil of excellent constancy of permeability for high frequency transformers.

What is claimed is:

1. A method of manufacturing a magnetic core having a magnetic permeability in the range of 100–600, which comprises applying a heat treatment to a magnetic core main body comprising an iron based amorphous alloy in a wet atmosphere containing 5 to 500 $g/m^3$ of steam, based on the amount of steam measured at 25° C. and atmospheric pressure.

2. A method of manufacturing a magnetic core according to claim 1, wherein said magnetic core main body is obtained by winding or laminating an iron based amorphous alloy.

3. A method of manufacturing a magnetic core according to claim 1, wherein the unit amount of steam contained in the wet atmosphere is in the range of 8–200 $g/m^3$.

4. A method of manufacturing a magnetic core according to claim 3, wherein the unit amount of steam contained in the wet atmosphere is in the range of 10–80 $g/m^3$.

5. A method of manufacturing a magnetic core according to claim 4, wherein the unit amount of steam contained in the wet atmosphere is in the range of 20–80 $g/m^3$.

6. A method of manufacturing a magnetic core according to claim 1, wherein the wet atmosphere comprises a nitrogen atmosphere.

7. A method of manufacturing a magnetic core according to claim 6, comprising applying the heat treatment at a temperature in the range of Tx-5° C. to Tx-100° C. in which Tx represents a crystallization temperature.

8. The method of manufacturing a magnetic core according to claim 2, comprising applying the heat treatment temperature is in the range of Tx-5° C. to Tx-100° C. in which Tx represents the crystallization temperature of the amorphous alloy.

9. A method of manufacturing a magnetic core according to claim 8, comprising applying the heat treatment at a temperature in the range of Tx-20° C. to Tx-60° C.

10. The method of manufacturing a magnetic core according to claim 1, wherein said iron based amorphous alloy has the following atomic formula $$Fe_xSi_yB_zM_w$$

wherein each of X, Y, Z and W represents a range of atom % and X is 50 to 85 atom %, Y is 5 to 15 atom %, Z is 5 to 25 atom %, W is 0 to 10 atom %; and M is an element selected from the group consisting of Ni, Nb, Ta, Mo, W, Zr, Cr, Mn, Al, P and combinations thereof.

11. A method of manufacturing a magnetic core having a magnetic permeability in the range of 100–600, which comprises applying a heat treatment, at a temperature of 436° C. to 481° C., in a nitrogen atmosphere, to a magnetic core main body comprised of an iron based amorphous alloy in a wet atmosphere containing 10 to 80 $g/m^3$ of steam, based on the amount of steam measured at 25° C. and atmospheric pressure.

12. A method of manufacturing a magnetic core having a magnetic permeability in the range of 100–600, which comprises applying a heat treatment, at a temperature of 445°–450° C. in a nitrogen atmosphere, to a magnetic core main body comprising an iron based amorphous alloy in a wet atmosphere containing 10 to 80 $g/m^3$, based on the amount of steam measured at 25° C. and atmospheric pressure.

13. The method of manufacturing a magnetic core according to claim 11 or claim 12 wherein the unit amount of steam contained in the wet atmospheric is in the range of 20 to 80 $g/m^3$.

* * * * *